US009629509B1

(12) United States Patent
Keily et al.

(10) Patent No.: US 9,629,509 B1
(45) Date of Patent: Apr. 25, 2017

(54) WET WIPE DISPENSER

(71) Applicant: DISPENSING DYNAMICS INTERNATIONAL, City of Industry, CA (US)

(72) Inventors: Joel P. Keily, Corona, CA (US); Charles Parkin Davis, Torrance, CA (US)

(73) Assignee: Dispensing Dynamics International, City of Industry, CA (US)

( * ) Notice: Subject to any disclaimer, the term of this patent is extended or adjusted under 35 U.S.C. 154(b) by 0 days.

(21) Appl. No.: 15/181,697

(22) Filed: Jun. 14, 2016

Related U.S. Application Data

(60) Provisional application No. 62/175,720, filed on Jun. 15, 2015.

(51) Int. Cl.
*B65H 1/08* (2006.01)
*A47K 10/42* (2006.01)
*A47K 10/32* (2006.01)

(52) U.S. Cl.
CPC .... *A47K 10/422* (2013.01); *A47K 2010/3273* (2013.01)

(58) Field of Classification Search
CPC ..... A47K 10/422; A47K 2010/3273
USPC ..... 221/59
See application file for complete search history.

(56) References Cited

U.S. PATENT DOCUMENTS

| | | | | |
|---|---|---|---|---|
| 2,044,284 | A * | 6/1936 | Dargavel | A47F 1/08 118/425 |
| 5,249,547 | A * | 10/1993 | Takada | B05C 3/18 118/415 |
| 5,672,206 | A | 9/1997 | Gorman | |
| 5,765,717 | A | 6/1998 | Gottselig | |
| 6,085,899 | A * | 7/2000 | Thorsbakken | A47K 10/32 206/205 |
| 6,346,153 | B1 | 2/2002 | Lake et al. | |
| 6,639,185 | B1 * | 10/2003 | McConnell | A47K 10/421 219/386 |
| 7,178,689 | B2 * | 2/2007 | Wieser | A47K 10/422 221/45 |
| 7,303,092 | B2 | 12/2007 | Sarbo et al. | |
| RE40,408 | E * | 7/2008 | McConnell | A47K 10/421 219/386 |
| 7,497,351 | B2 * | 3/2009 | Amundson | A47K 10/421 221/135 |
| 8,044,325 | B1 * | 10/2011 | Cooper | A47K 10/32 219/386 |
| 8,631,968 | B2 | 1/2014 | Taylor | |
| 9,101,250 | B2 * | 8/2015 | Ray | A47K 10/24 |
| 9,186,024 | B2 * | 11/2015 | Lee | A47K 10/426 |
| 2013/0153593 | A1 | 6/2013 | Silagy | |
| 2014/0174974 | A1 | 6/2014 | Bechyne | |
| 2015/0048104 | A1 | 2/2015 | Wilson et al. | |

* cited by examiner

*Primary Examiner* — Rakesh Kumar
(74) *Attorney, Agent, or Firm* — Thomas R. Lampe

(57) ABSTRACT

A wet wipe dispenser apparatus including a container, a top with a wipe egress opening, a wipe support for holding a stack of wet wipes biased for movement toward the top, and at least one wick in the container for applying moisture to wipes of the stack of wipes.

8 Claims, 4 Drawing Sheets

WET WIPE DISPENSER

This application claims the benefit of U.S. Provisional Patent Application No. 62/175,720, filed Jun. 15, 2015.

TECHNICAL FIELD

This invention relates to the field of dispensing, and more particularly to dispensers for serially dispensing wet wipes.

BACKGROUND OF THE INVENTION

A wet wipe, also known as a wet towel or a moist towelette, is a small moistened piece of paper or cloth that often comes folded. Wet wipes are used for cleaning purposes such as for personal hygiene or household cleaning, among other usages.

It is known in the prior art to individually wrap wet wipes for convenience. It is also known to provide dispensers holding a stacked plurality of wet wipes and individually dispensing the wet wipes serially through an opening formed in the dispenser.

In the latter situation, problems can be encountered in maintaining all of the wipes in the dispenser in a desired moist condition. For example, liquid in the wipes can fall to the bottom of the dispenser over time under the influence of gravity. This leaves the wipes that are positioned closest to an upper dispensing location in a dryer condition than the wipes furthest removed from that location.

The following patent documents are believed to be representative of the current state of the prior art in this field: U.S. Pat. No. 5,765,717, issued Jun. 16, 1998, U.S. Pat. No. 5,672,206, issued Sep. 30, 1997, U.S. Pat. No. 6,346,153, issued Feb. 12, 2002, U.S. Pat. No. 7,303,092, issued Dec. 4, 2007, U.S. Pat. No. 8,631,968, issued Jan. 21, 2014, U.S. Pat. No. 7,178,689, issued Feb. 20, 2007, U.S. Patent App. Pub. No. US 2014/0174974, pub. Jun. 26, 2014, U.S. Patent App. Pub. No. US 2015/0048104, pub. Feb. 19, 2015 and U.S. Patent App. Pub. No. US 2013/0153593, pub. Jun. 20, 2013.

DISCLOSURE OF INVENTION

The dispenser apparatus of the present invention is for holding a stack of wipes, maintaining the wipes in a moist condition, and serially manually dispensing wet wipes from said stack of wipes.

The dispenser apparatus includes a container defining a container interior.

A top is connected to the container and covers the container interior. The top defines a wipe egress opening through which a topmost wet wipe of the stack of wipes is manually accessed.

A wipe support is within the container interior and supports the stack of wipes, the wipe support being slidably mounted relative to the container.

A biasing structure biases the wipe support toward the top.

At least one wick in the container interior is in contact with or otherwise closely adjacent to the stack of wipes to apply moisture to wipes in the stack of wipes.

In preferred embodiments a wick or wicks soak up liquid that falls into the container bottom for subsequent distribution back to wipes in the container to prevent them from drying out.

Other features, advantages and objects of the present invention will become apparent with reference to the following description and accompanying drawings.

MODES FOR CARRYING OUT THE INVENTION

Figure 1:
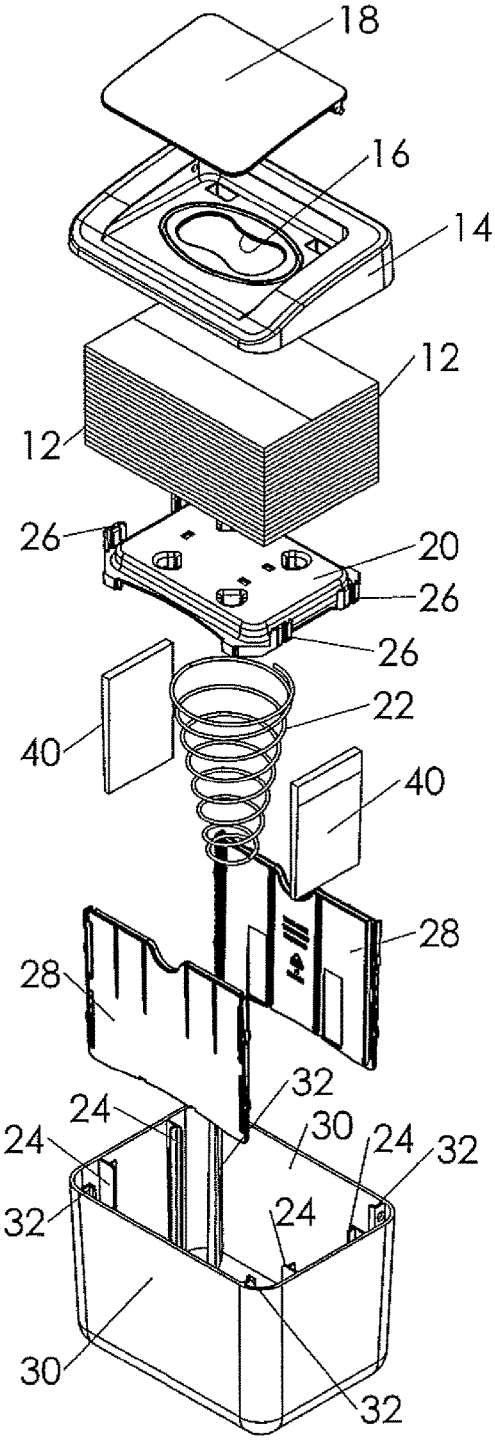
FIG. 1 is a exploded, perspective view illustrating components of a first embodiment of a wet wipe dispenser constructed in accordance with the teachings of the present invention.
Figure 2:
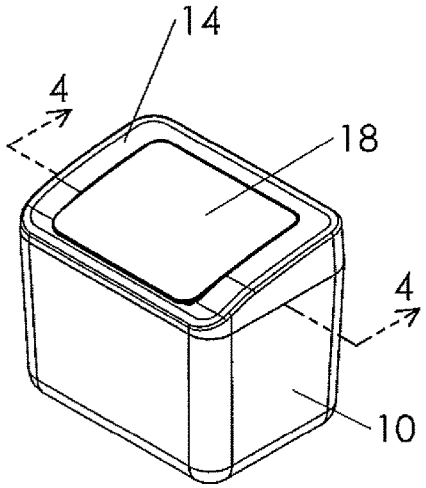
FIG. 2 is a perspective view of the assembled first embodiment with the cover lid closed.
Figure 3:
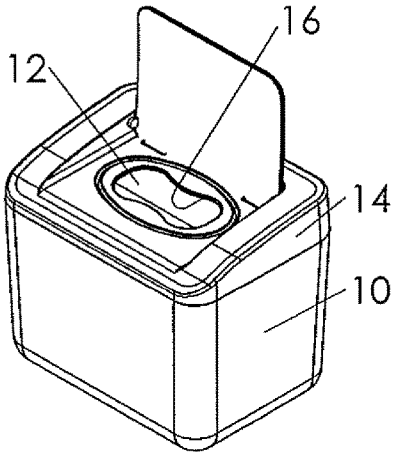
FIG. 3 is a view similar to FIG. 2 showing the lid open, allowing serial manual dispensing of wet wipes within the container of the first embodiment through a wipe egress opening.

Referring now to FIGS. 1-4, a preferred embodiment of wet wipe dispenser constructed in accordance with the teachings of the present invention is illustrated. The dispenser includes a container in the form of a tub 10 which holds a plurality of stacked wet wipes 12.

A cover in the form of top 14 is positioned over the interior of the tub 10 to cover the interior. The cover is connected to the container by any suitable known connector structure. The top 14 defines a wipe egress opening 16 through which a topmost wet wipe of the stack is manually dispensed.

A lid 18 is pivotally connected to top 14 and preferably the lid closes and seals automatically under the influence of gravity when not displaced by a user accessing a wet wipe.

A slidably movable wipe support 20 is located within the interior of the tub. The wipe support 20 supports a stack of wet wipes 12. A coil spring 22 between the wipe support 20 and the tub bottom continuously biases the wipe support (and the stack of wipes supported thereby) in the direction of top 14.

Elongated ribs 24 are incorporated in the tub, for example by being integrally molded with the rest of the tub. Wipe support 20 includes four indented guides 26 at the wipe support ends which receive ribs 24 and guide movement of the wipe support within the tub. Guidance of wipe support 20 is also provided by two guide plates 28 positioned adjacent to inner surfaces of opposed side walls 30 of the tub. The guide plates are disposed between the opposed side walls and channel members 32 projecting therefrom to maintain the guide plates in position.

An important feature of the present invention is the use of a wick or wicks to maintain the wet wipes in a stack of wet wipes in moistened condition. In the arrangement of the preferred embodiment as disclosed in FIGS. 1-4, the wicks 40 are in the form of rectangular pieces or pads of foam sheet material, such as plastic foam material, or other suitable wicking material. Wicks 40 are located between the tub bottom and the top 14 and are positioned between the ribs of each pair of ribs 24 disposed at the ends of the tub.

The wicks 40 are disposed in contact with or otherwise closely adjacent to edges of the stacked wipes to moisturize and maintain the wipes in the stack in moistened condition. The wicks may be dry prior to absorbing moisture from the wipe. Alternatively, the wick may also be pre-moistened.

The wet wipe dispenser may be wall mounted or table top. The dispenser may be potentially mounted inverted or facing away from a wall.

Figure 4:
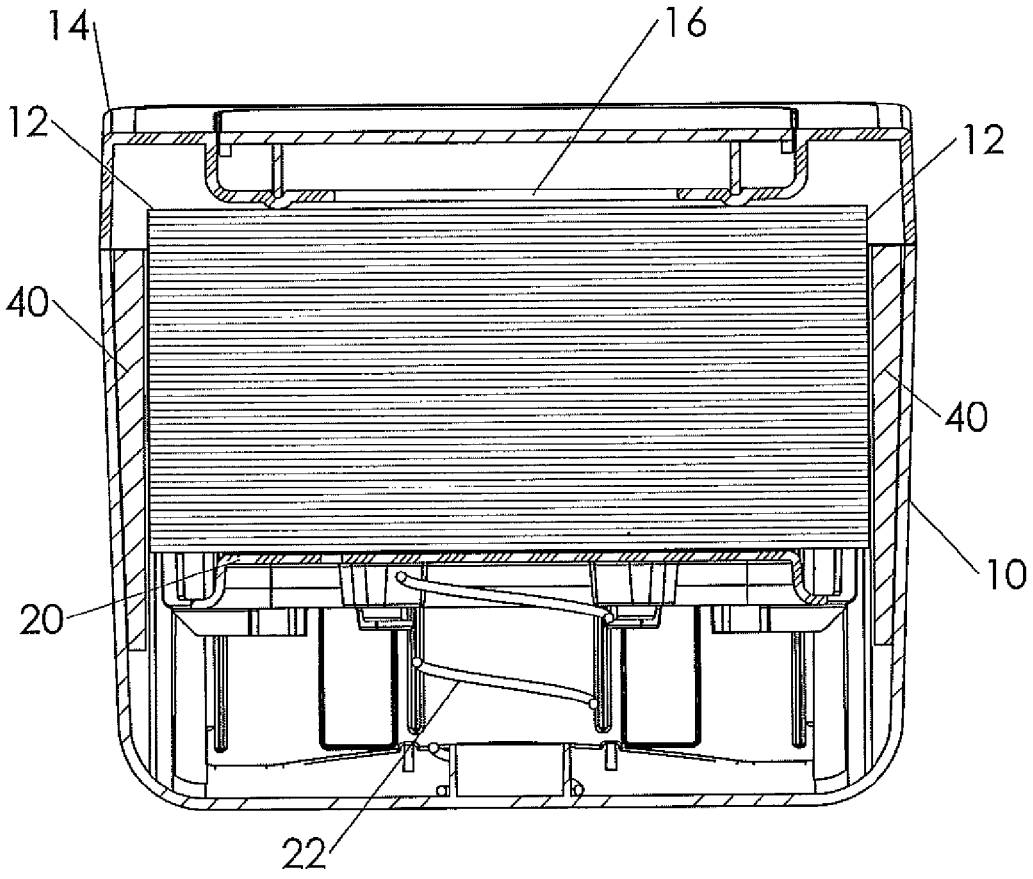
FIG. 4 is an enlarged, cross-sectional view taken along line 4-4 of FIG. 2.
Figure 5:
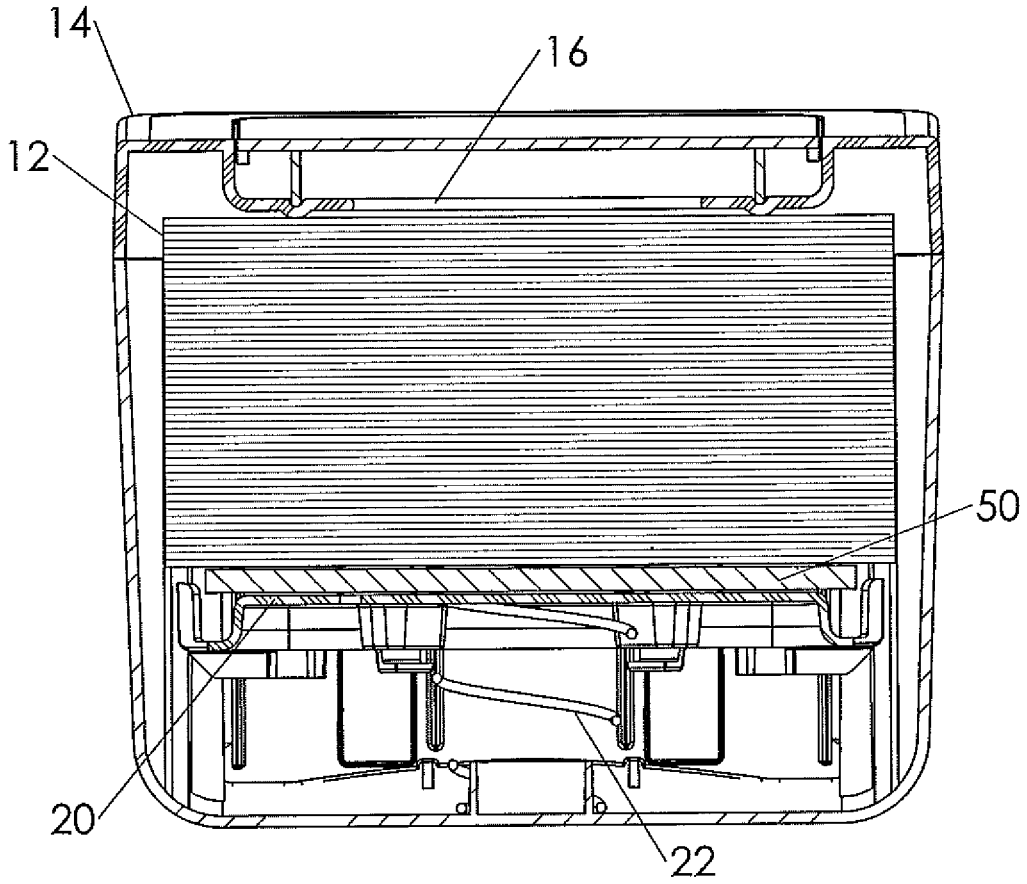
FIG. 5 is a view similar to FIG. 4 of a second embodiment of the invention.

FIG. 5 is a view similar to FIG. 4, but illustrating a second embodiment of the invention. This second embodiment is identical to that of FIG. 4 and the same reference numbers are used to designate the structural elements in common with the first embodiment. The only difference is that in the FIG. 5 embodiment a single wick 50 is utilized and wick 50 is located on and supported by wipe support 20.

Figure 6:
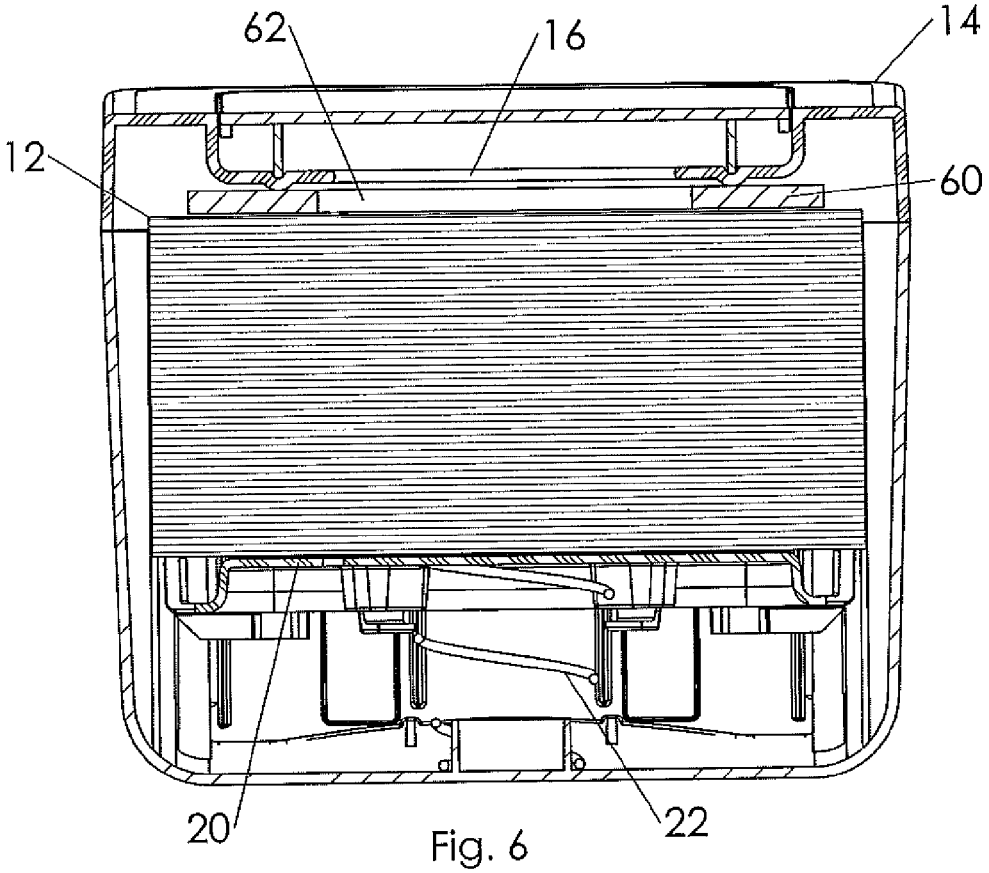
FIG. 6 is a view similar to FIG. 4 of a third embodiment of the invention.

FIG. 6 is a view similar to FIGS. 4 and 5, but illustrating a third embodiment of the invention. This third embodiment is identical to those of FIGS. 4 and 5 and the same reference numbers are used to designate the structural elements in common with the first and second embodiments. The only difference is that in the FIG. 6 embodiment a single wick 60 is employed and wick 60 is positioned on top of the stack of wet wipes and defines an opening 62 communicating with wipe egress opening 16 so that a topmost wipe may be accessed and pulled upwardly when dispensed.

The invention claimed is:

1. Dispenser apparatus for holding a stack of wipes having aligned edges, maintaining the wipes in a moist condition, and serially manually dispensing wet wipes from said stack of wipes, said dispenser apparatus comprising:

a container defining a container interior;

a top connected to said container and covering said container interior, said top defining a wipe egress opening through which a topmost wet wipe of the stack of wipes is manually dispensed;

a wipe support within said container interior supporting said stack of wipes, said wipe support slidably mounted relative to said container;

a biasing structure biasing said wipe support toward said top; and at least one wick in said container interior in contact with or otherwise closely adjacent to aligned edges of said stack of wipes to apply moisture to wipes in the stack of wipes, said at least one wick comprising a sheet of wicking material, said container including a container bottom and said sheet of wicking material extending upwardly from said container bottom alongside the aligned edges of said stack whereby liquid is wicked upwardly away from said container bottom and transferred sideways to the aligned edges of wipes in said stack to moisturize said stack between said top and said container bottom.

2. The dispenser apparatus according to claim 1 additionally including a lid pivotally connected to said top for sealing said wipe egress opening.

3. The dispenser apparatus according to claim 2 wherein said lid is operable to close and seal said wipe egress opening automatically under the influence of gravity when not displaced by a user accessing a wet wipe.

4. The dispenser apparatus according to claim 1 wherein a plurality of wicks are in said container interior and are in contact with or closely adjacent to the aligned edges of said stack of wipes at a plurality of locations on each wipe in the stack of wipes.

5. The dispenser apparatus according to claim 4 wherein said container includes a plurality of ribs extending into said container interior and wherein said wipe support includes indented guides receiving said ribs to guide movement of the wipe support within the container interior.

6. The dispenser apparatus according to claim 1 additionally including spaced guide plates connected to said container and extending into said container interior for engaging and guiding movement of said wipe support and the stack of wipes within said container interior.

7. Dispenser apparatus for holding a stack of wipes, maintaining the wipes in a moist condition, and serially manually dispensing wet wipes from said stack of wipes, said dispenser apparatus comprising:

a container defining a container interior;

a top connected to said container and covering said container interior, said top defining a wipe egress opening through which a topmost wet wipe of the stack of wipes is manually dispensed;

a wipe support within said container interior supporting said stack of wipes, said wipe support slidably mounted relative to said container;

a biasing structure biasing said wipe support toward said top; and a plurality of wicks in said container interior in contact with or otherwise closely adjacent to said stack of wipes to apply moisture to wipes in the stack of wipes, said container including a container bottom and said plurality of wicks located between said container bottom and said top and extending alongside said stack whereby liquid is wicked upwardly away from said container bottom and transferred to wipes in said stack, said plurality of wicks being in said container interior and in contact with or closely adjacent to said stack of wipes, said wipes having edges and said plurality of wicks applying moisture to a plurality of edges of wipes in the stack of wipes, said container including a plurality of ribs extending into said container interior and said wipe support including indented guides receiving said ribs to guide movement of the wipe support within the container interior, said plurality of wicks positioned between adjacent ribs of said plurality of ribs.

8. Dispenser apparatus for holding a stack of wipes, maintaining the wipes in a moist condition, and serially manually dispensing wet wipes from said stack of wipes, said dispenser apparatus comprising:

a container defining a container interior;

a top connected to said container and covering said container interior, said top defining a wipe egress opening through which a topmost wet wipe of the stack of wipes is manually dispensed;

a wipe support within said container interior supporting said stack of wipes, said wipe support slidably mounted relative to said container;

a biasing structure biasing said wipe support toward said top; and at least one wick in said container interior in contact with or otherwise closely adjacent to said stack of wipes to apply moisture to wipes in the stack of wipes, said at least one wick comprising a sheet of wicking material, said sheet of wicking material positioned at the top of the stack of wipes and said sheet of wicking material engaging the topmost wipe of the stack of wipes and defining an opening in communication with said wipe egress opening defined by said top whereby the topmost wipe of the stack of wipes may be manually pulled outwardly from the container interior through the opening and wipe egress opening when dispensed.

* * * * *